United States Patent [19]

Mori et al.

[11] 4,045,703

[45] Aug. 30, 1977

[54] FLAT ENVELOPE TYPE FLUORESCENT CHARACTER INDICATING TUBE WITH GETTER SHIELD PLATE

[75] Inventors: Yasamasu Mori; Kenzo Ashiuchi; Osamu Yasytome, all of Hyogoken; Tagayasu Sawamura, Himejishi, all of Japan

[73] Assignee: Tokyo Shibaura Electric Co., Ltd., Japan

[21] Appl. No.: 750,153

[22] Filed: Dec. 13, 1976

Related U.S. Application Data

[63] Continuation of Ser. No. 664,395, March 5, 1976, abandoned.

[30] Foreign Application Priority Data

Mar. 6, 1975 Japan ..... 50-26489

[51] Int. Cl.[2] ..... H01J 19/12; H01J 19/70; H01J 63/02

[52] U.S. Cl. ..... 313/497; 313/513; 313/181

[58] Field of Search ..... 313/496, 497, 174, 181, 313/519, 513

[56] References Cited

U.S. PATENT DOCUMENTS

| | | | |
|---|---|---|---|
| 3,197,546 | 7/1965 | Hopper, Jr. | 313/174 |
| 3,619,694 | 11/1971 | Tanji | 313/497 |

FOREIGN PATENT DOCUMENTS

| | | | |
|---|---|---|---|
| 2,348,186 | 4/1974 | Germany | 313/497 |

*Primary Examiner*—Palmer C. Demeo
*Attorney, Agent, or Firm*—Oblon, Fisher, Spivak, McClelland & Maier

[57] ABSTRACT

In a flat type fluorescent character indicating tube wherein a plurality of digit indicating elements are arranged in an evacuated envelope, there is provided a getter support structure located adjacent one end of the envelope. The getter support structure includes a shield plate extending toward the inner surface of the envelope to minimize distribution of the getter film toward the location of the digit indicating elements. At least one filament is extended above the digit indicating elements and its one end is secured to the getter support structure at a location beyond the shield plate.

7 Claims, 7 Drawing Figures

FLAT ENVELOPE TYPE FLUORESCENT CHARACTER INDICATING TUBE WITH GETTER SHIELD PLATE

This is a continuation of application Ser. No. 664,395, filed Mar. 5, 1976, and now abandoned.

BACKGROUND OF THE INVENTION

1. Field of the Invention

This invention relates generally to a flat envelope type fluorescent character indicating tube wherein a plurality of digit indicating elements are arranged in an evacuated envelope and more specially to an improved tube having a new and improved getter support structure.

2. Description of the Prior Art

There are many types of fluorescent character indicating tubes of the character described presently available, and one is a flat envelope type fluorescent character indicating tube wherein a plurality of co-planar letters and/or numeral indicating anode segments are arranged on an insulating base plate, and the fluorescent material is disposed on each of the anode segments. The visible location of digits is controlled by the mesh control grids which are disposed in front of the anode segments.

As this type of tube is formed by sealing a flat envelope cover with the base plate mentioned above, it is possible to obtain a compact electron tube as compared to the conventional elongated circular envelope type tube.

However, this type of tube has some technical problems resulting from its compact size.

One is the distribution of the evaporated getter film.

It is well known that, in order to maintain the required degree of vacuum in an electron tube, the generally used technique is to employ a getter. The getter consists of a thin metallic film deposited on appropriate surfaces of the tube envelope. This thin metallic film is usually of barium and is commonly deposited from a getter source container which may be heated by externally induced radio frequency currents.

As a matter of fact, the flat envelope type fluorescent character indicating tube also employs a getter for absorbing the residual gases in its vacuum envelope.

But, in this type of tube, it happens that the digit indicating elements are made dirty and the insulation among the electric circuits is spoiled on account of the evaporated getter film. Also if the getter film is deposited on the surface which faces the digit elements, the light indicating the indicia would become obscure.

Another difficulty is the so called "end cooling effect" of the cathode filament.

In this type of tube, a directly heated filament is disposed in front of the mesh control grid for emitting electrons toward the phosphor segments. As the filament is usually stretched by a pair of support elements, the amount of emission of electrons from near the filament supporting point is usually reduced, as compared to the amount from other points of the filament. This reduction of electron emission is called an end cooling effect, and it influences the brightness of the digit, especially that being located near the end of the filament. To avoid this influence, it is necessary to support the filament at a location as far as possible from the end digit element. However, in doing so, it becomes difficult to obtain an envelope of a compact size.

SUMMARY OF THE INVENTION

Therefore, the objects of this invention are directed toward the provision of an improved flat envelope type fluorescent character indicating tube.

According to this invention, the foregoing and other objects are attained by providing a flat envelope type fluorescent character indicating tube having a plurality of digit indicating elements which are arranged on a base plate, a new getter support structure including a shield plate for minimizing the distribution of an evaporated getter film toward the location of the digit indicating elements and an elongated filament being extended above the digit indicating elements with its one end being secured to the new getter support structure beyond the shield plate thereof.

BRIEF DESCRIPTION OF THE DRAWINGS

This invention will be more clearly understood from the following detailed description taken in conjunction with the accompanyng drawings, in which like reference characters designate the same or similar parts throughout the figures thereof and wherein.

DESCRIPTION OF THE PREFERRED EMBODIMENTS

Figure 1:
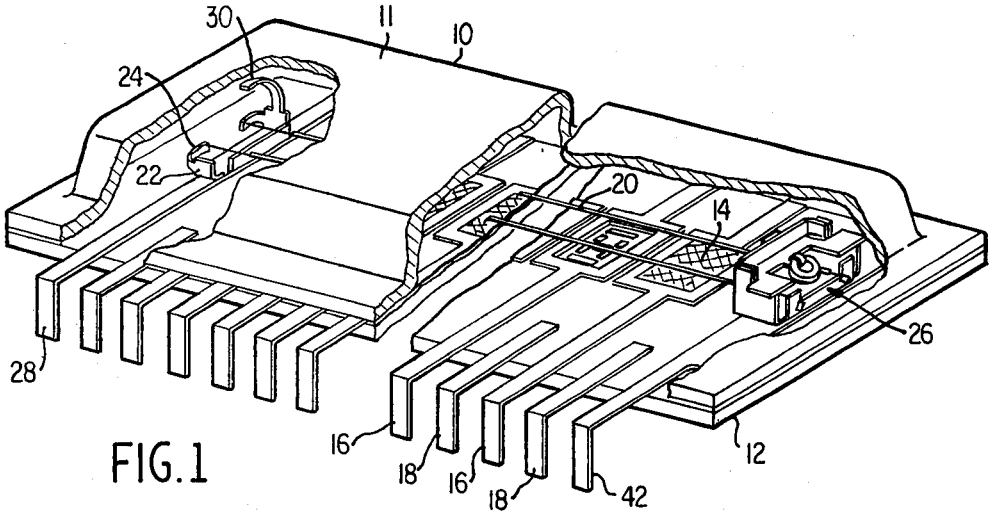
FIG. 1 is a perspective view, partly in section, of one embodiment of the invention.

The character indicating tube utilized with this invention is illustrated in FIG. 1 and comprises a sealed envelope having an envelope cover 10 including a transparent viewing window 11 and a base plate 12 of an insulating material, such as glass or ceramic or the like. A plurality of electric circuits are printed on the base plate 12. After coating a thin insulating layer over the electric circuits, a plurality of electrode groups are printed. Each electrode group contains a plurality of spaced apart anode segments in a predetermined form, which are located at the corresponding positions in each of the electrode groups and are electrically connected in common to an individual electric circuit through the insulating layer. A phosphor material such as zinc oxide or the like is arranged on each anode segment. A plurality of mesh control grids 14 are disposed above each of the electrode groups. A control grid and an associated electrode group comprise one digit indicating element to permit the indication of specific indicia, such as numerals one through nine and zero. The plurality of mesh control grids 14 are electrically connected to individual outer leads 16. The plurality of corresponding anode segments are also electrically connected to individual outer lead 18. At least one directly heated filament or cathode 20 is disposed lengthwise of the base plate above the mesh grid 14 and is secured to the base plate by a support member 22 including a spring anchor 24 and a getter support structure 26.

The support member 22 is located adjacent one end of the base plate 12 and electrically connected to the lead 28. A spring connector 30 is disposed on the support member 22.

The spring connector 30 is electrically in contact with a transparent conductive film such as, $SnO_2$, which is coated at least on the inner surface of the viewing window 11 of the envelope cover 10 and is connected through the lead 28 to an electric shielding potential.

One end of the filament 20 is attached to the spring anchor 24 of the support member 22 and the other end is secured to the getter support structure 26 at the other end of the base plate 12 by electric welding or the like.

Figure 2:
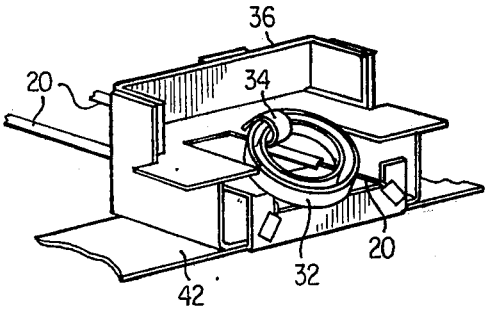
FIG. 2 is a perspective view of one embodiment of the getter support structure shown in FIG. 1.
Figure 3:
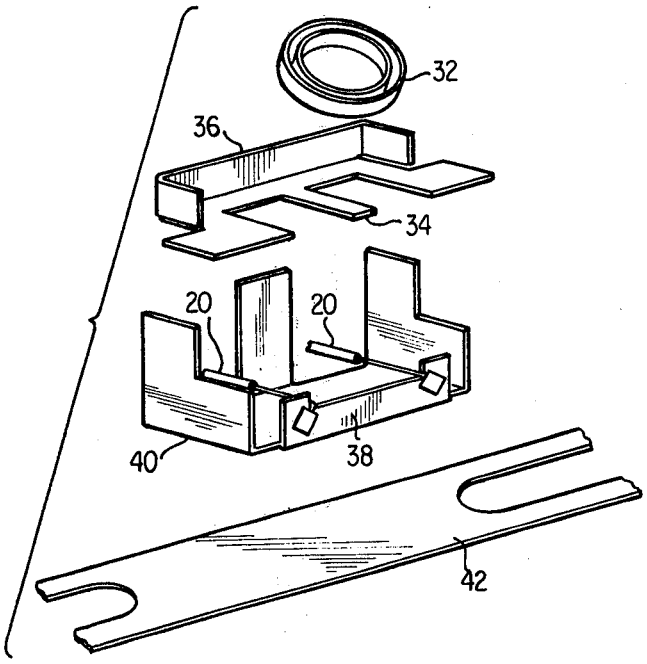
FIG. 3 is an exploded view of the structure shown in FIG. 2.

The details of the getter support structure 26 in FIG. 1 will now be explained accompanying FIGS. 2 and 3. FIG. 3 shows an exploded view of FIG. 2.

As mentioned above, it is well known that, in order to maintain the required degree of vacuum in the tube envelope, a getter is usually employed. The getter film is usually of barium and is commonly deposited from a getter source container 32.

The getter container 32 usually consists of a non-magnetic stainless steel ring of U-shaped section. In this invention, a getter shield plate 36 is provided and the getter source container 32 is attached to a support portion 34 of the shield plate 36 by electric welding or the like.

The getter shield plate 36 consists of a metal or a non-magnetic stainless steel or the like. The shield plate 36 is located adjacent the end digit indicating element and extends vertically toward the inner surface of the envelope cover 10 so as to minimize distribution of the getter film toward the location of the digit element. In this embodiment, the shield plate comprises a U-shaped element so as to screen the getter container, but it is possible to use a flat shield plate, if desired.

The shield plate 36 is assembled with a filament support member 38 and finally a getter support structure is constructed. As shown in FIG. 3, the filament support member 38 includes an idle space 40, and the one end of the filament 20 is secured at a location beyond the shield plate 36. According to this structure, the aforementioned influence according to the end cooling effect of a filament is mostly prevented.

The getter support structure 26 is electrically connected to a conductor 42.

Figure 4:
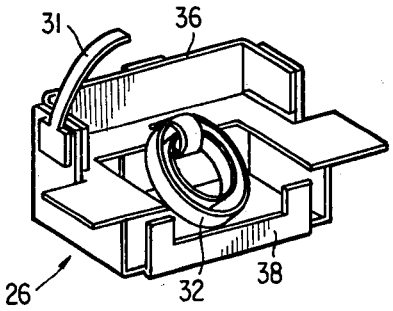
FIG. 4 is a perspective view of the getter support structure to which an elastic connector is attached.

FIG. 4 illustrates another embodiment of this invention. According to this embodiment, a spring-like connector 31 is mounted on the getter support structure 26 to electrically contact the conductive film on the viewing window surface in the same manner as does the connector 30 in the embodiment of FIG. 1.

Figure 5:
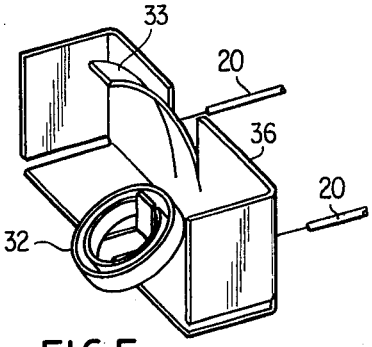
FIGS. 5 and 6 are perspective views of another FIGS. of this invention in which the getter support structure and an elastic connector are made in an integral structure.
Figure 6:
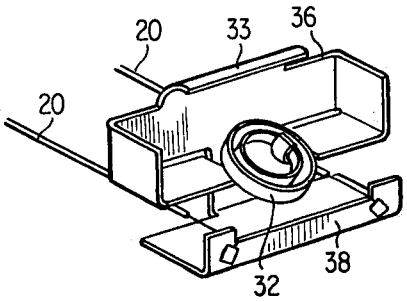

FIGS. 5 and 6 illustrate another embodiment of the getter support structure in which a shield plate 36 and a spring-like connector 33 are constructed in an integral form. In other words, the spring-like connector 33 is also used for the shield plate. In FIG. 6, a filament support member 38 also is constructed in an integral form with the shield plate 36.

Figure 7:
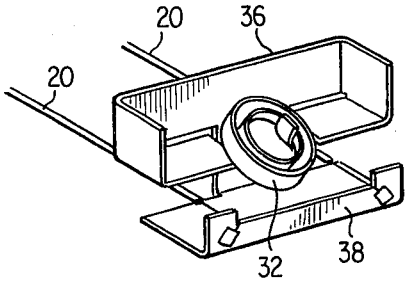
FIG. 7 is a perspective view of a simplified embodiment of the getter support structure.

FIG. 7 shows a simplified getter support structure in which a shield plate 36 and a filament support member 38 are constructed in an integral form. In this embodiment, the connector is located at an opposite end to the location of the getter support structure, as shown in FIG. 1.

According to this invention, it is possible to control the distribution of an evaporated getter film so as to flash in an area being screened by a shield plate. Also, as the end of the filament is secured at a location beyond the shield plate, it is possible to keep the same brightness in all of the digit in spite of using a compact envelope.

Furthermore, according to this invention, an electric shield is achieved by a simple construction.

While only certain embodiments of the invention have been illustrated and described, it is understood that various changes, modifications and alterations can be made without departing from the scope of the invention as set forth in the appended claims.

What is claimed is:

1. A flat envelope type fluorescent character indicating tube comprising:

a base plate;

an envelope cover having a transparent conductive film at least partially on its inner surface, said envelope cover being sealed with said base plate for constructing an evacuated envelope;

a plurality of digit indicating elements being arranged lengthwise on said base plate, each of said elements having a plurality of anode segments shaped to indicate predetermined indicia and a control grid for selecting the indicating digit location;

a getter source container;

a getter support structure located adjacent one end portion of said base plate and positioned thereon for supporting said getter source container and having a shield plate, said shield plate extending toward said inner surface of said envelope cover to minimize distribution of getter film toward the location of said digit element; and at least one elongate filament being extended above said digit indicating elements, one end of said filament being secured to said getter support structure at a location beyond said shield plate.

2. The flat envelope type fluorescent character indicating tube of claim 1 wherein said shield plate comprises a generally U-shaped member.

3. The flat envelope type fluorescent character indicating tube of claim 1, including a spring-like connector which contacts said transparent conductive film being coated on the inner surface of the envelope cover.

4. The flat envelope type fluorescent character indicating tube of claim 3, wherein said connector is mounted on said getter support structure.

5. The flat envelope type fluorescent character indicating tube of claim 3, wherein said spring-like connector is said shield plate.

6. The flat envelope type fluorescent character indicating tube of claim 1, including a plurality of electrical conductors which are extended through the sealed portion of the envelope.

7. The flat envelope type fluorescent character indicating tube of claim 3, wherein said connector is constructed integrally with said shield plate.

* * * * *

UNITED STATES PATENT AND TRADEMARK OFFICE

CERTIFICATE OF CORRECTION

PATENT NO. : 4,045,703

DATED : August 30, 1977

INVENTOR(S) : YASAMASU MORI ET AL

It is certified that error appears in the above-identified patent and that said Letters Patent are hereby corrected as shown below:

Please delete:

"[75] Yasamasu Mori; Kenzo Ashiuchi;
Osamu Yasytome, all of Hyogoken;
Tagayasu Sawamura, Himejishi, all of
Japan"

and insert therefor:

--[75] Yasamasu Mori; Kenzo Ashiuchi;
Osamu Yasatome, all of Hyogoken;
Tagayasu Sawamura, Himejishi, all of
Japan--.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*